US005720828A

United States Patent [19]

Strom-Olsen et al.

[11] Patent Number: 5,720,828

[45] Date of Patent: Feb. 24, 1998

[54] PERMANENT MAGNET MATERIAL CONTAINING A RARE-EARTH ELEMENT, IRON, NITROGEN AND CARBON

[75] Inventors: John Olaf Strom-Olsen; Xinhe Chen, both of Montreal; Le Xiang Liao, Vancouver; Zaven Altounian, Pointe-Claire; Dominic Hugh Ryan, Baie d,Urfe, all of Canada

[73] Assignee: Martinex R&D Inc., Montreal, Canada

[21] Appl. No.: 387,753

[22] PCT Filed: Aug. 20, 1993

[86] PCT No.: PCT/CA93/00341

§ 371 Date: Feb. 15, 1995

§ 102(e) Date: Feb. 15, 1995

[87] PCT Pub. No.: WO94/05021

PCT Pub. Date: Mar. 3, 1994

[30] Foreign Application Priority Data

Aug. 21, 1992 [GB] United Kingdom ..... 9217760

[51] Int. Cl.$^6$ ..... H01F 1/03

[52] U.S. Cl. ..... 148/104; 148/101; 148/122; 419/11; 419/14; 419/29

[58] Field of Search ..... 148/101, 103, 148/104, 122; 419/11, 14, 29; 75/236, 238, 243

[56] References Cited

U.S. PATENT DOCUMENTS

| | | | |
|---|---|---|---|
| 4,891,078 | 1/1990 | Ghandehari et al. | 75/236 |
| 4,978,398 | 12/1990 | Iwasaki et al. | 419/11 |
| 5,085,715 | 2/1992 | Tokunaga et al. | 148/101 |
| 5,085,716 | 2/1992 | Fuerst et al. | 148/301 |
| 5,096,509 | 3/1992 | Endoh et al. | 148/101 |
| 5,122,203 | 6/1992 | Bogatin | 148/301 |
| 5,137,587 | 8/1992 | Schultz et al. | 148/103 |
| 5,137,588 | 8/1992 | Wecker et al. | 148/103 |
| 5,211,766 | 5/1993 | Panchanathan | 148/101 |
| 5,240,513 | 8/1993 | McCallum et al. | 148/104 |
| 5,282,904 | 2/1994 | Kim et al. | 148/101 |

FOREIGN PATENT DOCUMENTS

| | | | |
|---|---|---|---|
| 0 369 097 | 5/1990 | European Pat. Off. . | |
| 0 453 270 | 10/1991 | European Pat. Off. . | |
| 0 470 475 | 2/1992 | European Pat. Off. . | |
| 0 493 019 | 7/1992 | European Pat. Off. . | |
| 0 506 412 | 9/1992 | European Pat. Off. . | |
| 41 33 214 A1 | 4/1992 | Germany . | |
| 61-208806 | 9/1986 | Japan . | |
| 63-53203 | 3/1988 | Japan | 148/104 |

OTHER PUBLICATIONS

Surface Treating Method and Permanent Magnet, vol. 11, No. 46.

*Primary Examiner*—John Sheehan

*Attorney, Agent, or Firm*—Bachman & LaPointe, P.C.

[57] ABSTRACT

Magnetic materials containing a rare earth metal, and iron or a similar metal, as well as nitrogen and carbon, are produced by gas absorbing nitrogen and carbon sequentially into a parent intermetallic compound; the resulting magnetic materials have high $T_c$, $\mu_o M_s$ and $\mu_o H_A$, are essentially free of α-Fe, and have a coercivity at 300° K. of at least 1.5 T. Anisotropic magnetic materials are produced by pretreating the intermetallic compound, which contains carbon, by powder sintering or oriented hot shaping, followed by nitriding and/or carbiding.

18 Claims, 13 Drawing Sheets

PERMANENT MAGNET MATERIAL CONTAINING A RARE-EARTH ELEMENT, IRON, NITROGEN AND CARBON

TECHNICAL FIELD

This invention relates to ferromagnetic materials, more especially ferromagnetic materials which contain a rare earth element, iron, nitrogen and carbon, and optionally hydrogen.

The invention relates to both isotropic and anisotropic magnetic materials.

BACKGROUND ART

Ferromagnetic materials and permanent magnets are important materials widely used in electrical and electronic products. The well-established $Nd_2Fe_{14}B$ based magnets have a high saturation magnetization, $\mu_o M_s$, of 1.6 T, high anisotropy field, $\mu_o H_A$, of 6.7 T and high energy product, $(BH)_{max.}$, of 360 kJ/m$^3$ at room temperature. However, the low Curie temperature, $T_c$, of 310° C. seriously reduces the performance above room temperature.

In recent years, many studies have been conducted on the nitrides and carbides of rare earth iron compounds, and two compounds, $Sm_2Fe_{17}N_{2.3}$ and $Sm_2Fe_{17}C_2$, have been formed with characteristics superior to $Nd_2Fe_{14}B$. For example, the parameters for $Sm_2Fe_{17}N_{2.3}$ are $T_c$=485° C., $\mu_o M_s$=1.5 T, $\mu_o H_A$=15 T, and for $Sm_2Fe_{17}C_2$ are $T_c$=407° C., $\mu_o M_s$=1.4 T and $\mu_o H_A$=13.9 T. These parameters imply that magnets made from these alloys could have an energy product as high as 470 kJ/m$^3$, with a superior $T_c$. However, the α-Fe precipitated during the nitriding is found to reduce the performance of hard magnets based solely on the nitrides. Furthermore, it is found that above 300° C., a significant quantity of nitrogen is released, reducing $T_c$.

In contrast, many carbides, despite their relatively smaller $T_c$ and $\mu_o H_A$, contain little precipitated α-Fe and have no problems with outgassing.

DISCLOSURE OF THE INVENTION

It is an object of this invention to provide novel intermetallic substances containing iron, a rare earth element, nitrogen and carbon.

It is a particular object of this invention to provide such intermetallic substances in the form of magnetic materials, including isotropic magnetic materials and anisotropic magnetic materials.

It is a further object of this invention to provide a process for producing the intermetallic substances.

It is yet another object of this invention to provide shaped magnetic articles.

In accordance with one aspect of the invention there is provided a magnetic material of formula (I):

$$R_\chi(Fe_{1-\eta}M_\eta)_y N_\alpha C_\beta H_\gamma \quad \text{(I)}$$

wherein

R is at least one element selected from Nd, Pr, La, Ce, Tb, Dy, Ho, Er, Eu, Sm, Gd, Pm, Tm, Yb, Lu and Y;

M is at least one element selected from Ti, V, Cr, Mn, Fe, Co, Ni, Zr, Nb, Mo, Hf, Ta, W, B, Al Si, P, Ga, Ge and As;

χ is 0.1–8.5;

y is 15–19;

α is 0.5–4;

β is 0.01–3.5;

γ is 0–6;

η is 0–0.95;

and α+β is less than or equal to 4, preferably less than or equal to 3; said material, in particulate form, having a fully nitrided core substantially free of carbon, and an outer shell comprising $Fe_3C$; said material being substantially free of α-Fe and having a coercivity at 300° K. of at least 1.5 T.

In accordance with another aspect of the invention there is provided a shaped magnetic article formed from the material of formula (I).

In still another aspect of the invention there is provided a magnetic powder comprising the material of formula (I) in particulate form.

In yet another aspect of the invention there is provided a process for producing the material of formula (I), as defined above, which comprises gas absorbing nitrogen and carbon, and hydrogen if present, from a gaseous atmosphere, into a particulate intermetallic compound of formula (II):

$$R_\chi(Fe_{1-\eta}M_\eta)_y \quad \text{(II)}$$

to form the material of formula (I), the compound of formula (II) being of rhombohedral or hexagonal Crystal structure.

In particular the material of formula (I) is a magnetic material having a high $T_c$, $\mu_o M_s$ and $\mu_o H_A$, essentially free of precipitated α-Fe, and exhibits high stability.

In another aspect of the invention there is provided an anisotropic magnetic material of formula (III):

$$R_\chi(Fe_{1-\eta}M_\eta)_y N_{\alpha'''} C_{\beta''} \quad \text{(III)}$$

wherein

R is at least one element selected from Nd, Pr, La, Ce, Tb, Dy, Ho, Er, Eu, Sm, Gd, Pm, Tm, Yb, Lu and Y;

M is at least one element selected from Ti, V, Cr, Mn, Fe, Co, Ni, Zr, Nb, Mo, Hf, Ta, W, B, Al, Si, P, Ga, Ge and As;

χ is 0.1–8.5;

y is 15–19;

η is 0–0.95;

α''' is 0–3.9; and

β'' is 0.1–4;

provided that at least one of N with α''' being 0–3.9 and C with β'' being 0.1–4 is present, and provided that α'''+β'' is less than or equal to 4, said magnetic material having a c-axis oriented in a predetermined direction.

In still another aspect of the invention there is provided a process for producing a magnetically anisotropic magnetic material having a c-axis oriented in a predetermined direction comprising powder sintering oriented hot shaping a material having a main phase of formula (IV):

$$R_\chi(Fe_{1-\eta}M_\eta)_y C_\delta \quad \text{(IV)}$$

wherein

R is at least one element selected from Nd, Pr, La, Ce, Tb, Dy, Ho, Er, Eu, Sm, Gd, Pm, Tm, Yb, Lu and Y;

M is at least one element selected from Ti, V, Cr, Mn, Fe, Co, Ni, Zr, Nb, Mo, Hf, Ta, W, B, Al, Si, P, Ga, Ge and As;

χ is 0.1–8.5;

y is 15–19;

η is 0–0.95; and

δ is 0.05–2, preferably 0.1–1;

and thereafter gas-absorbing at least one of N and C in the resulting material.

In yet another aspect of the invention there is provided a process for producing a magnetically anisotropic magnetic material having a c-axis oriented in a predetermined direction comprising powder sintering or oriented hot shaping an intermetallic material containing at least one rare-earth metal R, as defined hereinbefore, iron and carbon, and may contain at least one M, as defined hereinbefore, and having a main phase of $Th_2Zn_{17}$ or $Th_2Ni_{17}$ structure and a $T_c$, enhanced by interstitial carbon, of 400–600 K, and/or a uniaxial anisotropic field, induced by interstitial carbon, of 0.1–7 T at 300° K., and thereafter gas absorbing at least one of N and C in the resulting material.

MODES FOR CARRYING OUT THE INVENTION i) Intermetallic Substance

The intermetallic substance of the invention, being a material of formula (I) as described hereinbefore is, in particular, a magnetic material exhibiting superior characteristics with respect to $T_c$, $\mu_o M_s$ and $\mu_o M_A$, while being essentially free of precipitated α-Fe.

The material of formula (I) can be produced, in accordance with the invention, in isotropic or anisotropic form.

The metal M is preferably selected from Co, Ni, Ti, V, Nb and Ta, and, in particular, is selected from Co and Ni.

An especially preferred rare earth element is Sm or Sm mixed with one or more other rare earth elements; χ is preferably 2–3 and y is preferably 17.

In further preferred embodiments α is 1.8–3, β is 0.01–1.2 and η is 0–0.45.

The magnetic material of formula (I) is formed as particles in which the lattice spaces of the crystal structure forming the core of each particle, are substantially filled with nitrogen and substantially free of carbon; and the core is surrounded by a shell comprising iron carbide $Fe_3C$ derived from α-Fe.

The magnetic material (I) is substantially free of α-Fe; the latter typically provides nucleation sites for reverse magnetization; the magnetic material (I) of the invention is thus stable against reverse magnetization, The core of the particles of magnetic material (I) can thus be considered to have the formula $R_\chi(Fe_{1-\eta}M_\eta)_yN_{\alpha'}$ in which α' is usually 2–4, preferably about 3, with the shell comprising $Fe_3C$ and a phase of formula $R_\chi(Fe_{1-\eta}M_\eta)_yN_{\alpha''}C_{\beta'}$ in which α" is 0–1 and β' is 2–4, α"+β" is 2–5. Preferably the latter phase is of formula $R_2(Fe_{1-\eta}M_\eta)_{17}C_2$.

The magnetic material (I) has in particular a coercivity at 300° K. of at least 1.5 T. The coercivity being a measure of how much reverse magnetic field the material (I) can be exposed to, without magnetization being reversed.

For anisotropic magnet, the nitrogen-rich core may not exist, the coercivity is at least 0.5 T at 300° K.

The material of formula (I) may be employed in particulate form as a magnetic powder, or may be mixed with a polymer and shaped to form a bonded magnet or shaped magnetic article.

ii) Process of Manufacture

The material (I) of the invention is produced from the corresponding particulate intermetallic compound of formula (II) as defined hereinbefore.

In particular the intermetallic compound should have a particle size of less than 40 μm and the gas absorption of nitrogen and carbon, and the optional gas absorption of hydrogen is achieved by annealing the particulate intermetallic compound (II) in an appropriate nitrogen and carbon atmosphere, sequentially to provide the nitrogen and carbon, and the hydrogen, if desired. When hydrogen is also employed the intermetallic compound may have a particle size of less than or equal to 10 mm.

Nitrogen is first absorbed by the particles of intermetallic compound (II) from a nitriding atmosphere. This has the effect of substantially filling the interstices of the crystal structure with nitrogen, this being accompanied by expansion of the structure; at the same time, α-Fe is formed on the surface of the particles.

Carbon is then absorbed from a carbiding atmosphere, however, since the interstices are filled with nitrogen, there are no spaces in the core of the particles for carbon to occupy, and the carbon is confined to reaction with α-Fe at the surface of the particles, thus converting the α-Fe to $Fe_3C$, and carbon may also fill the interstices near the surface which were previously filled by nitrogen, since the nitrogen may leave these sites during carbiding.

The magnetic material (I) produced in this way, is typically isotropic.

The sequence of nitriding, following by carbiding, is essential to produce the structure described hereinbefore which results in isotropic magnetic material of superior characteristics.

iii) Nitriding

The nitriding of the intermetallic compound (II) can be achieved in different ways.

In a first method an N gas, namely nitrogen or a nitrogen-containing gas, for example ammonia or hydrazine is mixed with hydrogen in a ratio of N gas: $H_2$ of $1:10^4$ to $10^4:1$, preferably 1:5 to 5:1, and the compound (II) is annealed in the gas mixture at a temperature of 300°–800° C., preferably 400°–600° C., and a gas pressure of 0.1–10 bar, preferably 0.5 to 2 bar for 0.01–1000, preferably 0.1–50 hours.

In a second method the intermetallic compound (II) is annealed in an N-containing gas at 300°–800° C., preferably 400°–600° C., at a gas pressure of 0.01–100 bar, preferably 0.1–10 bar, more preferably 0.5 to 2 bar, for a period of 0.01–1000, preferably 0.1–50 hours.

In a third method the intermetallic compound (II) is first annealed in hydrogen at 200° to 700° C., preferably 250° to 350° C., at a pressure of 0.01 to 100 bar, preferably 0.1 to 10 bar, for 0.01 to 10 hours, preferably 0.1 to 1 hour.

The hydrogen is readily absorbed and causes expansion of the crystal structure thereby facilitating subsequent nitriding.

The resulting particles are annealed in an N-containing gas during which nitrogen readily displaces hydrogen, at 300° to 800° C., preferably 400° to 600° C., at a gas pressure of 0.01 to 100 bar, preferably 0.1 to 10 bar, for a period of 0.01 to 1000 hours, preferably 0.1 to 50 hours. Prior to nitriding the residual hydrogen gas atmosphere can optionally be removed.

In a fourth method the N-containing gas is activated, for example by microwave radiation or laser radiation and the intermetallic compound (II) is annealed in the activated N-containing gas at 300°–800° C., preferably 400°–600° C., at a gas pressure of 0.01–100 bar, preferably 0.01–10 bar, for a period of 0.01–1000 hours, preferably 0.1–50 hours.

The intermetallic compound (II) conveniently has a particle size of 0.1 to $10^4$ μm, preferably 10 to $10^3$ μm, if hydrogen is employed, and a particle size of less than 40 μm if no hydrogen is employed.

iv) Carbiding

The carbiding is carried out employing a carbon containing gas, for example a hydrocarbon gas, for example methane, ethylene, acetylene or butane. Oxygen containing gases such as carbon dioxide should be avoided.

Suitably the nitrided intermetallic compound (II) is annealed in the carbon containing gas at temperatures and pressures as indicated above for the nitriding. Typically the temperature will be from 350°–600° C., preferably 400°–500° C., and the pressure from 0.1 to 10 bar. The time for carbiding is generally short since only a surface reaction is occurring, involving conversion of α-Fe to $Fe_3C$; typically the time will be 0.5–60, preferably 5–20, more preferably 10–15 minutes.

Similar to nitriding process, carbon-containing gas may also be activated and hydrogen may also be involved in the carbiding process.

v) Hydrogen

Hydrogen may be absorbed separately from an atmosphere of hydrogen by annealing at a temperature of 200° to 500° C., at a pressure of 0.1 to 10 bar, for up to several hours.

vi) Intermetallic Compound

The intermetallic compound (II) may be prepared from the individual alloying elements R, Fe and M by conventional techniques, for example arc melting, induction melting, mechanical alloying, rapid quenching, Hydrogenation Decomposition Desorption Recombination (HDDR) and powder sintering, optionally, followed by thermal annealing.

The thermal annealing is suitably carried out at a temperature of 500°–1280° C. for 0–30 days, in a vacuum or in an inert gas, for example helium or argon.

The resulting alloy is pulverized, if necessary, to obtain the particle size of less than 40 μm; this may be achieved by grinding or milling, for example ball milling or jet milling, or by a combination of grinding and milling.

The pulverization step may not be necessary for intermetallic compounds prepared by mechanical alloying. The pulverization step may not be necessary if hydrogen is involved in nitriding and carbiding processes.

vii) Anisotropic Magnetic Materials

Employing the procedures outlined above an isotropic magnetic material (I) is invariably formed. These procedures as well as related procedures can be applied to the production of anisotropic magnetic material of formula (III):

$$R_{102}(Fe_{1-\eta}M_{\eta})_{y}N_{\alpha''40}C_{\beta''} \quad \text{(III)}$$

in which χ, y, η, R and M are as defined for formula (I), α''' is 0–3.9, preferably 1.8–2.9 and β" is 0.1–4, preferably 0.1–1.2, provided that at least one of N and C is present.

In the manufacture of the anisotropic magnetic material (III) an intermetallic compound having a main phase of formula (IV):

$$R_{102}(Fe_{1-\eta}M_{\eta})_{y}C_{\delta} \quad \text{(IV)}$$

wherein R, M. χ, ηand y are as defined for (I) and δ is 0.05–2, preferably 0.1–1, is oriented by hot shaping or is powder sintered, or both. The resulting material is nitrided and/or carbided employing N-containing gas and/or carbon containing gases as described for the magnetic materials (I), to form a magnetically anisotropic material with the c-axis oriented in a preferred direction and having a coercivity greater than 0.5 T.

Alternatively the intermetallic starting material has a main phase of $Th_2Zn_{17}$ or $Th_2Ni_{17}$ structure and may be defined as one containing at least one rare-earth metal R, as defined hereinbefore, iron and carbon, and optionally at least one metal M, as defined hereinbefore, and having a Curie temperature, enhanced by interstitial carbon, of 125°–330° C., and/or a uniaxial anisotropic field, induced by interstitial carbon of 0.1–7 T at 300° K.

The intermetallic compound (IV) is prepared by melting the elements together or by mechanical alloying, rapid quenching and HDDR, and carbon is introduced either by melting or by gas-solid reaction. The resulting intermetallic compound (iv) is, optionally, annealed in vacuum or in inert gas at 600°–1300° C. for up to 10 weeks, preferably at 1000°–1200° C. for 0.5 to 20 hours to produce a material having uniaxial anisotropy with an easy c-axis anisotropy.

The resulting material may then be treated by one of two techniques to produce a magnetically anisotropic compact. In a first technique the material in bulk or compacted powder form is subjected to an oriented hot shaping process, for example die-upset, hot rolling or hot extrusion, in a vacuum or inert gas at 600°–1250° C.

In a second technique the material is reduced to a particle size of 0.1–50 μm, preferably 1–10 μm, for example by pulverization, and the resulting powder, optionally mixed, with up to 30 at. % powder of R and/or M, is aligned in a static magnetic field of 0.2–8 T, preferably 0.5–2 T. The oriented powder is compacted to a dense compact of desired shape, for example by mechanical pressing.

The pressing direction is either parallel or perpendicular, preferably perpendicular to the aligned direction. The resulting compact is sintered in vacuum or in inert gas at 800°–1300° C. for up to 10 hours, and preferably at 900°–1200° C. for 2 to 60 minutes. At the completion of sintering, an aligned compact with a magnetic phase of $Th_2Zn_{17}$ or $Th_2Ni_{17}$ crystal structure is obtained.

The compact from the first or the second technique has the c-axis aligned in a preferred direction and is then subjected to nitriding and/or carbiding from the gas phase. The nitriding and/or carbiding is carried out on the bulk compact or on powder having a particle size of 0.1 to $10^4$ μm, preferably 10 to $5\times10^3$ μm.

In one option nitriding is carried out by annealing in a mixture of an N-containing gas and hydrogen as described previously suitably at 300°–800° C., preferably 400°–600° C. for 0.01–1000 preferably 0.5 to 100 hours.

In another option the material is annealed in hydrogen at 200°–600° C., preferably 250°–350° C., at a pressure of 0.1–10 bar, preferably 0.5–2 bar, for 0.1 to 10 hours, preferably 15–60 minutes. After, optionally, removing residual hydrogen atmosphere the material is nitrided with N-containing gas, optionally mixed with hydrogen at 300°–800° C., preferably 400°–600° C. for up to 1000 hours, preferably 0.5–100 hours, at a pressure of 0.1–10 bar.

Other options of nitriding described in iii) for isotropic material may also be applied to anisotropic material.

The material can also be carbided or can be carbided but not nitrided.

If carbiding is carried out alone, with no nitriding, one of the methods described in iv) above may be employed.

If both nitriding and carbiding are employed the sequential operation described in ii) above may be employed or the nitriding and carbiding can be carried out in a single operation from a mixture of N-containing gas and carbon containing gas, optionally with hydrogen gas; or sequentially with the carbiding step first, followed by nitriding.

If N-containing gas is present the conditions described above for nitriding are employed, if a separate carbiding step is employed, this is suitably carried out at 300°–800° C., preferably 400°–600° C., for up to 2 hours, preferably 2–30 minutes. If carbiding only, the time is for up to 1000 hours, preferably 0.1–100 hours.

If a mixture of N-containing gas and C-containing gas is used, the nitrogen to carbon ratio in the gas mixture is 1:10000 to 10000:1. The other conditions are similar to the nitriding process.

Inert gas may be present during the nitriding and/or carbiding.

The resulting product, optionally containing hydrogen, is magnetically anisotropic with easy axis (c-axis) aligned in a preferred direction, and having a coercivity of greater than 0.5 T.

The product may be employed, in bulk form, as an anisotropic magnet or, in powder form, may be bonded with metal, polymer or epoxy resin to a shaped anisotropic article or film.

DESCRIPTION OF PREFERRED EMBODIMENTS WITH REFERENCE TO THE DRAWINGS

Figure 1:
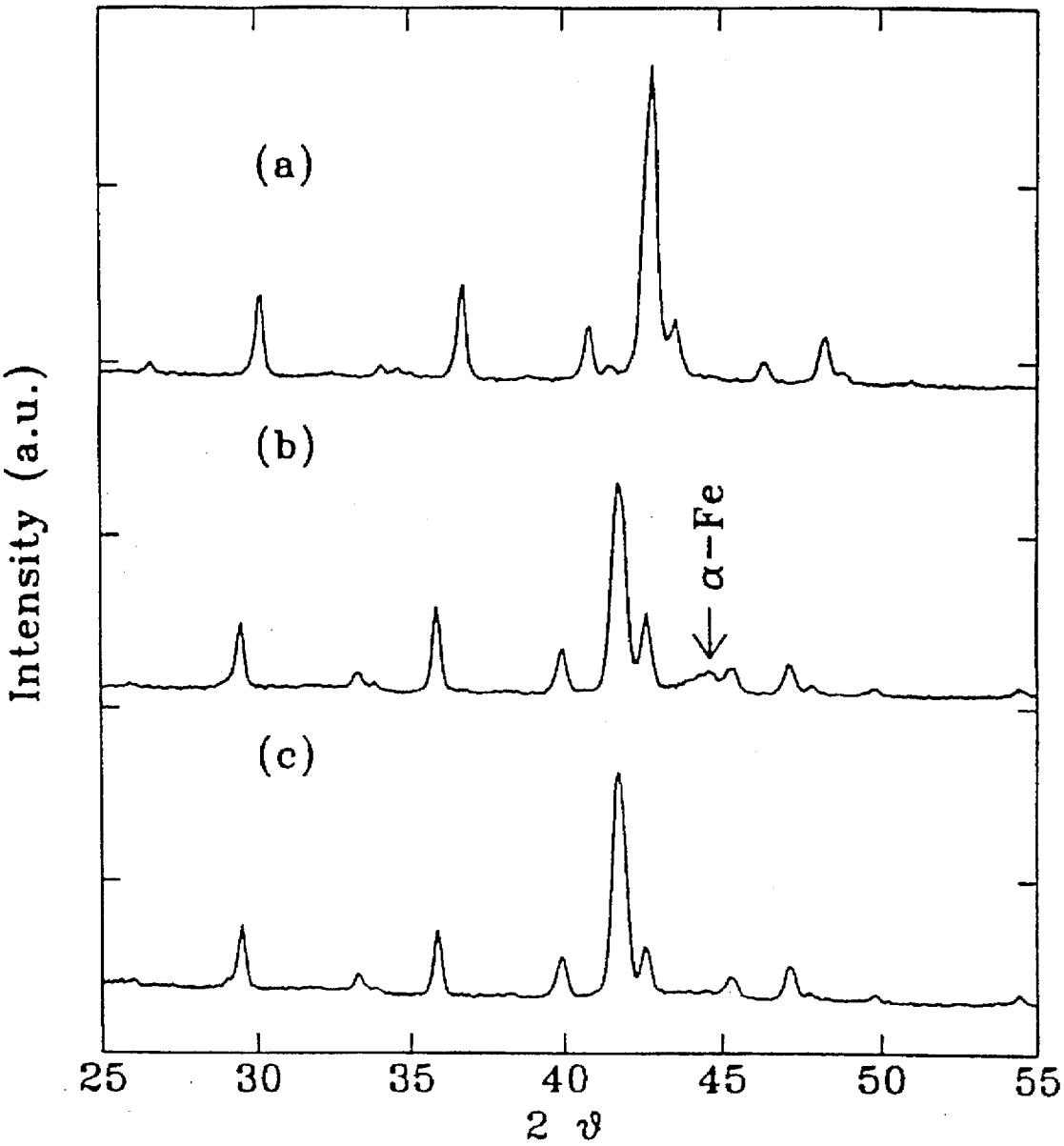
FIG. 1 shows X-ray (Cu $K_\alpha$) powder diffraction patterns of (a) $Dy_2Fe_{17}$, (b) nitride of $Dy_2Fe_{17}$, (c) carbonitride containing hydrogen of $Dy_2Fe_{17}$.

FIG. 1 (*a*) shows a typical X-ray diffraction of $Dy_2Fe_{17}$. All peaks can be indexed by a single phase of hexagonal structure. No traces of other phases are observed. The same material was annealed at 500° C. in $N_2$ gas for 120 minutes, the resulting material has the same structure with expanded lattice constants. X-ray diffraction (FIG. 1*b*) shows the existence of α-Fe with the nitride. The subsequent annealing of the nitride in $C_2H_2$ gas at 500° C. for 20 minutes eliminates the α-Fe, resulting in a single phase of the hexagonal structure with the same lattice constants as that of the nitrides (FIG. 2*c*).

Figure 2:
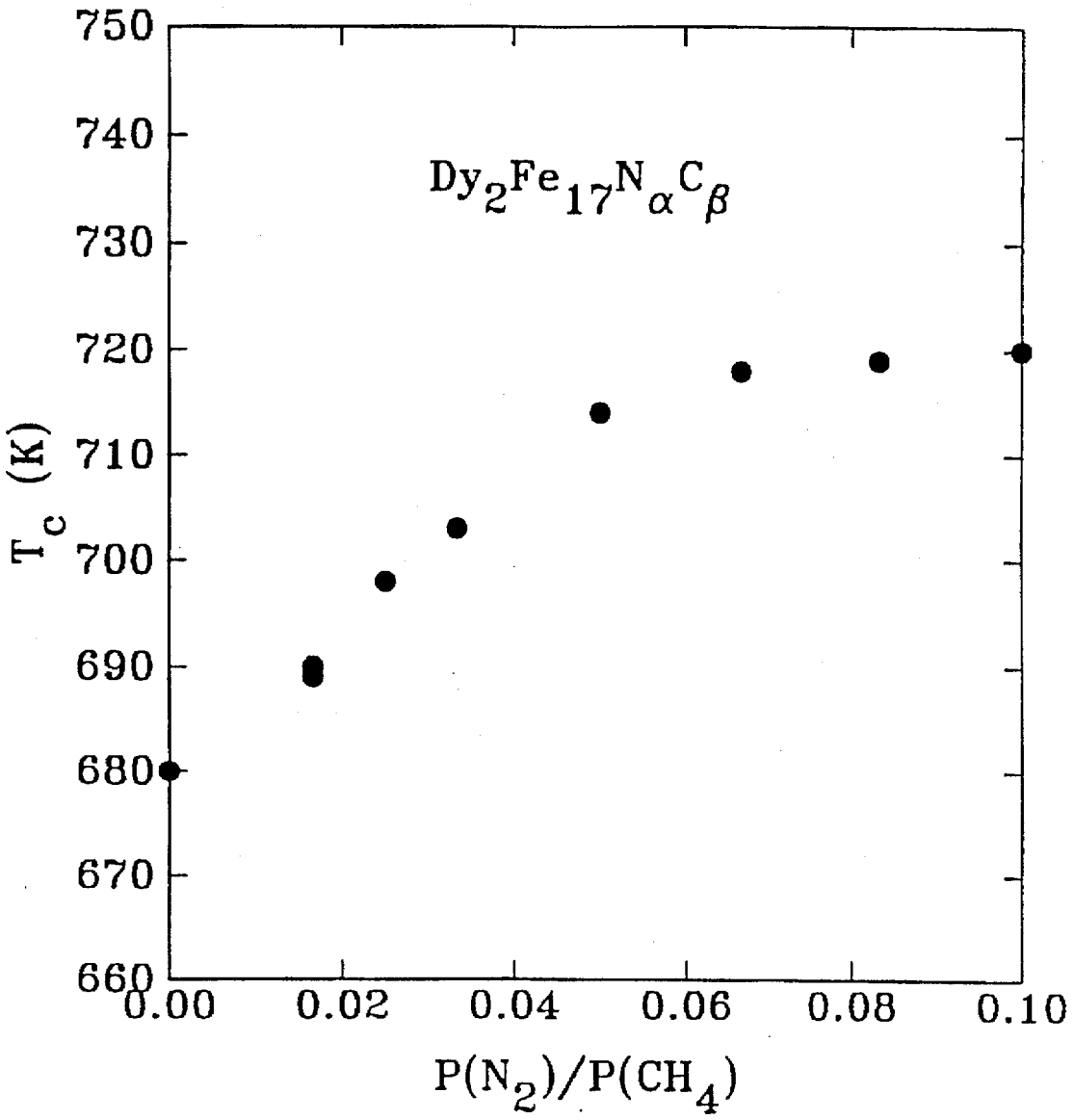
FIG. 2 is a plot showing the Curie temperature of $Dy_2Fe_{17}N_\alpha C_\beta H_\gamma$ as a function of gas pressure ratio, $P(N_2)/P(CH_4)$ which Curie temperature reaches saturation at $P(N_2)/P(CH_4)=0.07$.
Figure 3:
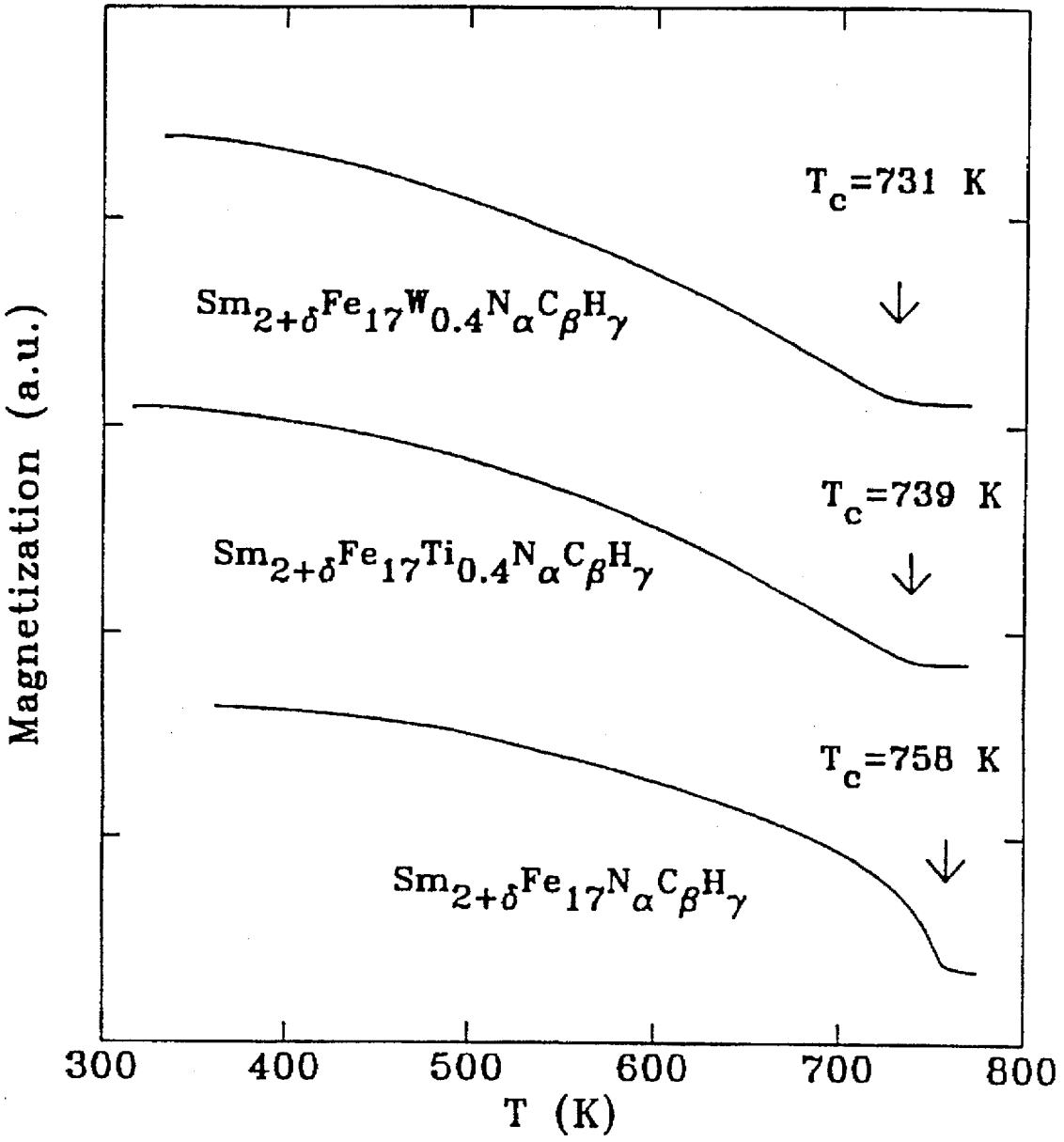
FIG. 3 shows Curie temperatures of $Sm_{2+\gamma}Fe_{17}M_{0.4}N_\alpha C_\beta H_\gamma$ for M=Ti, Fe and W.
Figure 4:
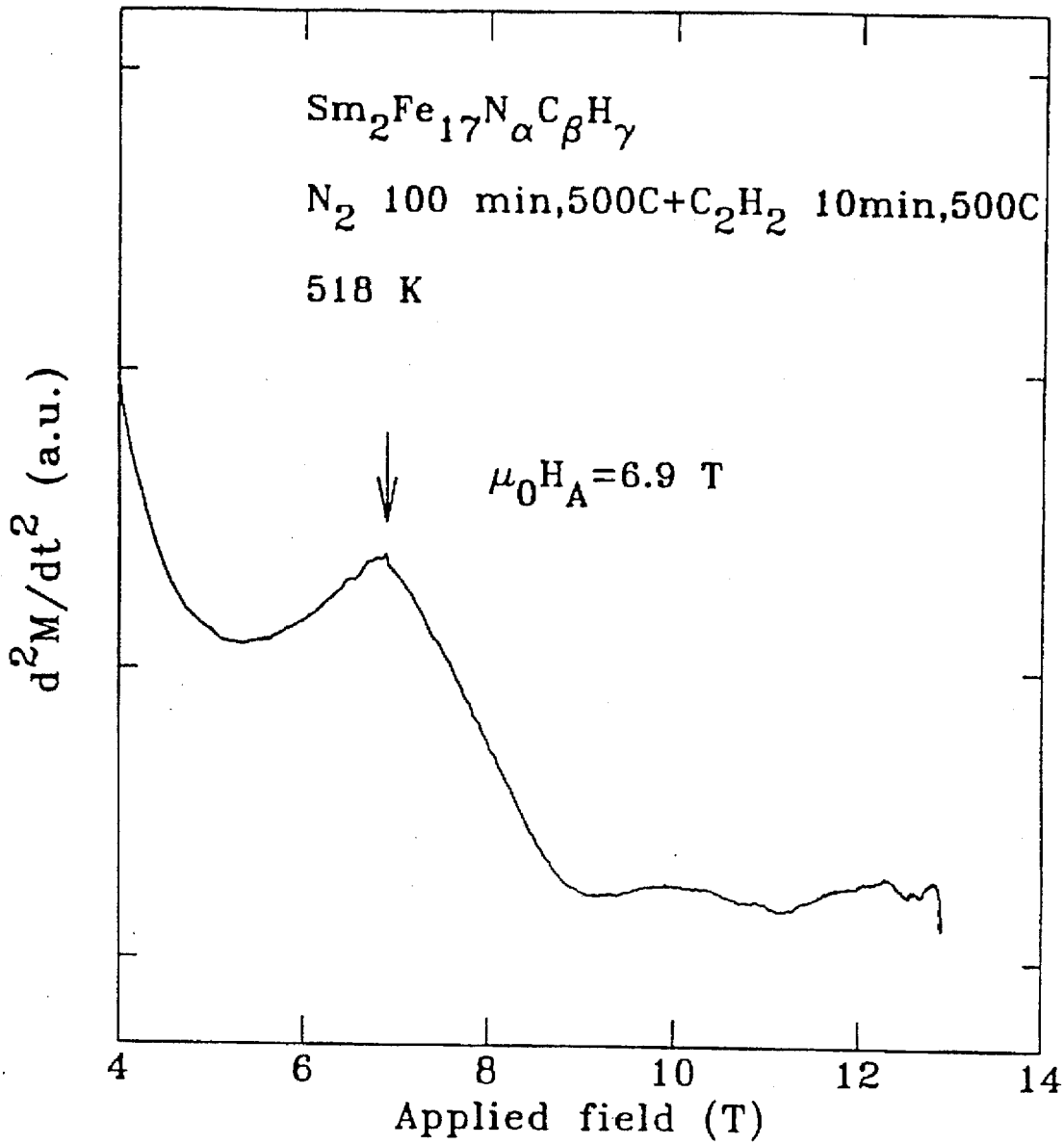
FIG. 4 is a typical $d^2M/dt^2$ trace for $Sm_2Fe_{17}N_\alpha C_\beta H_\gamma$ showing the maximum at 6.9 T corresponding to $\mu_o H_A$ at 518 K, where M is the magnetization and t is time.
Figure 5:
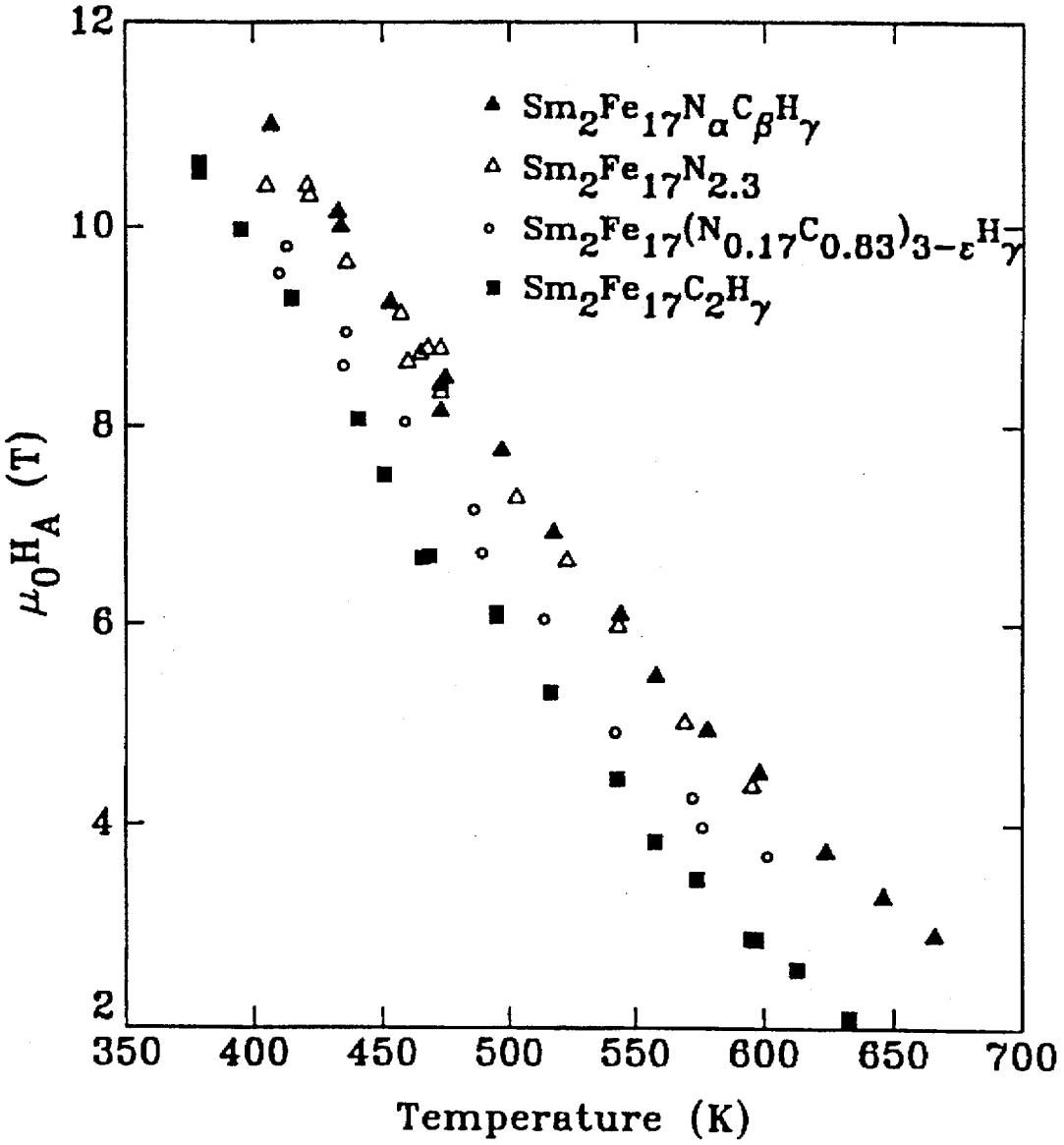
FIG. 5 is a plot showing the anisotropy field as a function of temperature for $Sm_2Fe_{17}N_\alpha C_\beta H_\gamma$ with various contents of N.

The $T_c$ of the $R_\chi Fe_y N_\alpha C_\beta H_\gamma$ is a function of gas pressure ratio. FIG. 2 shows typical results measured on the specimens with R=Dy. The lowest value of $T_c$ is at $P(N_2)/P(CH_4)=0$, whereas a saturation value is obtained at $P(N_2)/P(CH_4)=0.07$. This means that a relatively small percentage of N is sufficient to raise the $T_c$ of the $R_\chi Fe_y N_\alpha C_\beta H_\gamma$ to that of the corresponding nitrides. The $T_c$ of the $R_\chi(Fe_{1-\eta}M_\eta)_y N_\alpha C_\beta H_\gamma$ is also related to M. FIG. 3 shows the typical results measured on the specimens with R=Sm and M=Ti, Fe and W.

Figure 6:
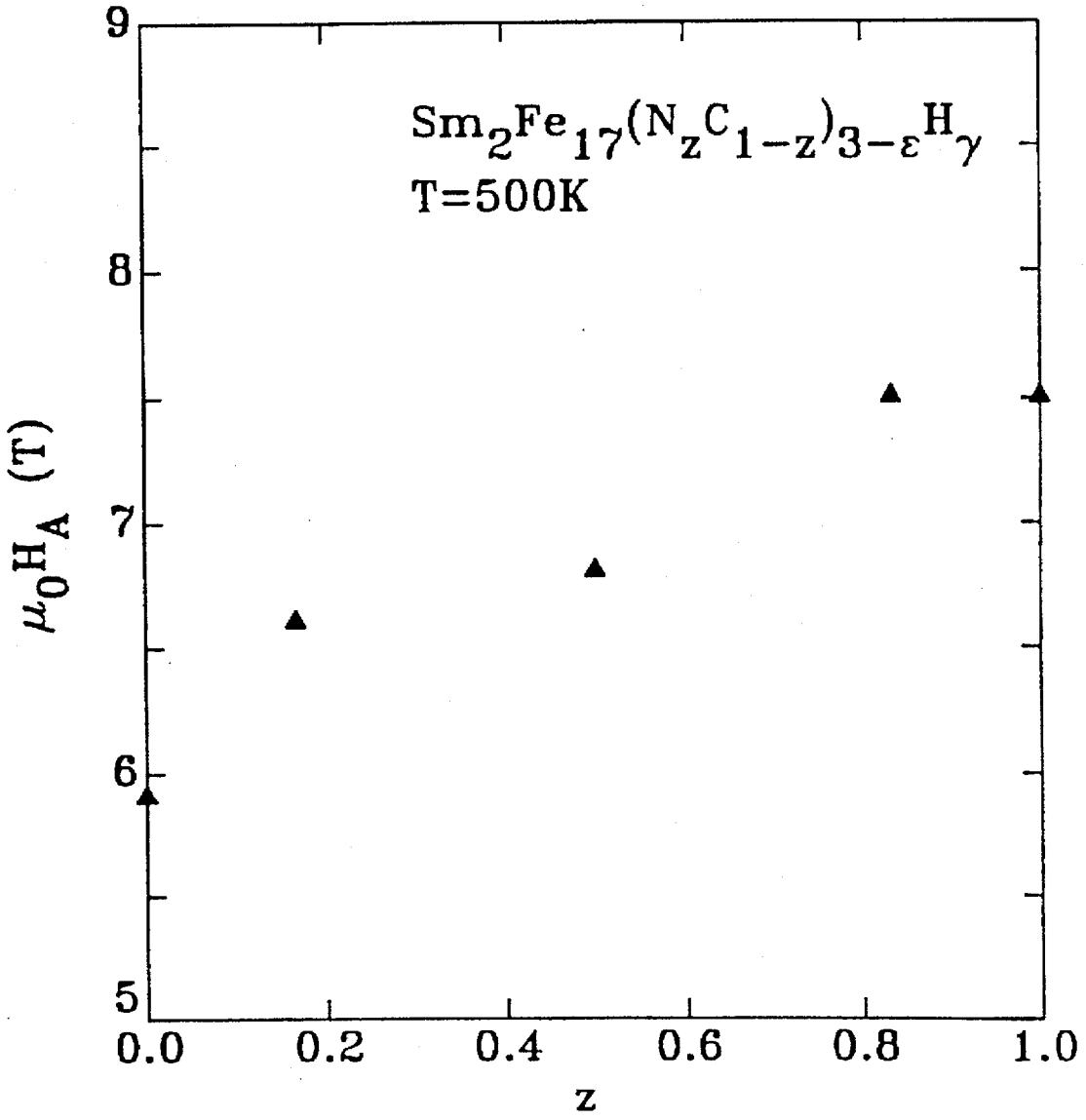
FIG. 6 shows the anisotropy field at 500° K. for different nitrogen contents Z in $Sm_2Fe_{17}N_\alpha C_\beta H_\gamma$.
Figure 7:
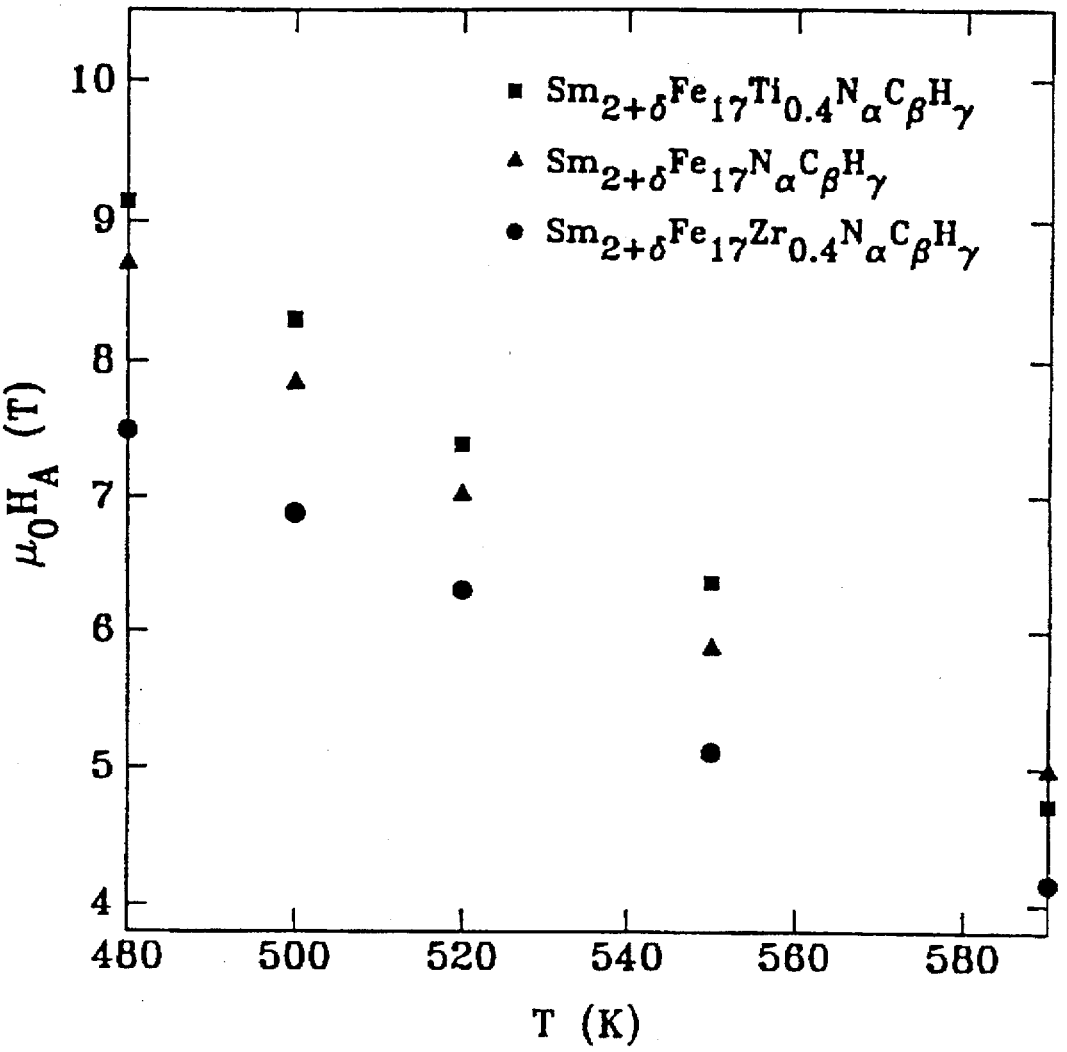
FIG. 7 is a plot showing the temperature dependence of the anisotropy field of $Sm_{2+\delta}Fe_{17}M_{0.4}N_\alpha C_\beta H_\gamma$ (M=Ti, Fe and Zr; $\delta \leqq 0.6$); the values are not corrected for the demagnetizing field.
Figure 8:
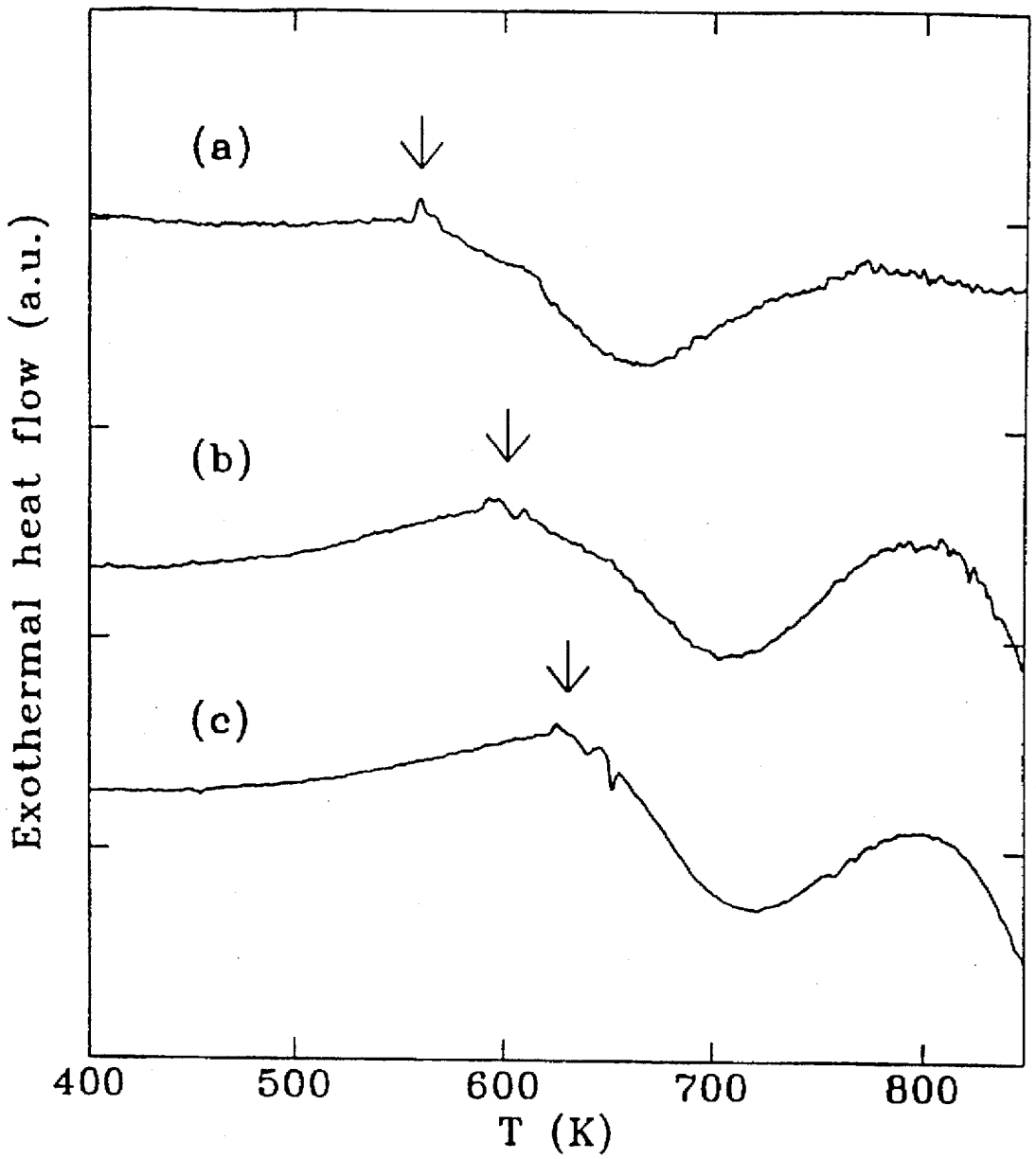
FIG. 8 shows the onset temperature for $N_2$ outgassing from $Sm_2Fe_{17}N_\alpha C_\beta H_\gamma$ prepared by absorbing gas of (a) $N_2$, 500° C., 100 minutes; (b) $N_2$ 500° C., 100 minutes+$C_2H_2$, 500° C., 10 minutes; (c) $N_2$, 500° C., 100 minutes+$C_2H_2$, 500° C., 20 minutes.

The compound with R=Sm is the only one showing uniaxial anisotropy at room temperature. Typical data are shown in FIGS. 4–9. The $\mu_o H_A$ increases monotonically as nitrogen content increases. When nitrogen fraction is 0.83 (FIG. 7) the value of $\mu_o H_A$ reaches a maximum. Therefore, high N content is desirable for $Sm_\chi(Fe_{1-\eta}M_\eta)_y N_\alpha C_\beta H_\gamma$ in order to obtain the highest $\mu_o H_A$. The $\mu_o H_A$ is related to M. As is shown in FIG. 7, M=Ti gives the highest $\mu_o H_A$.

A typical way to produce the best $R_\chi(Fe_{1-\eta}M_\eta)_y N_\alpha C_\beta H_\gamma$ is to anneal the $R_\chi(Fe_{1-\eta}M_\eta)_y$ powder in $N_2$ in about 1 bar at 450° C. for 9 hours, followed by a 10–20 minute annealing in $C_2H_2$ at a similar pressure and same temperature. Table 1 shows the crystal structures and magnetic properties of $R_\chi(Fe_{1-\eta}M_\eta)_y N_\alpha C_\beta H_\gamma$. Table 2 shows the magnetic properties and lattice constants of $Sm_{2+\delta}Fe_{17}M_{0.4}N_\alpha C_\beta H_\gamma$ ($\delta \leqq 0.6$). The $Sm_{2+\delta}Fe_{17}M_{0.4}N_\alpha C_\beta H_\gamma$ prepared in this way has the advantages of both nitrides and carbides, i.e. high $T_c$, $\mu_o M_s$ and $\mu_o H_A$, and little α-Fe.

The onset temperature of N outgassing from the carbonitrides is shifted at least about 40 K toward higher temperature, as compared with the pure nitrides. FIG. 6 shows a set of typical curves on $Sm_2Fe_{17}N_\alpha C_\beta H_\gamma$ by differential scanning calorimetry. The increase of the onset temperature indicates an improved thermal stability for the new magnetic materials.

Figure 9:
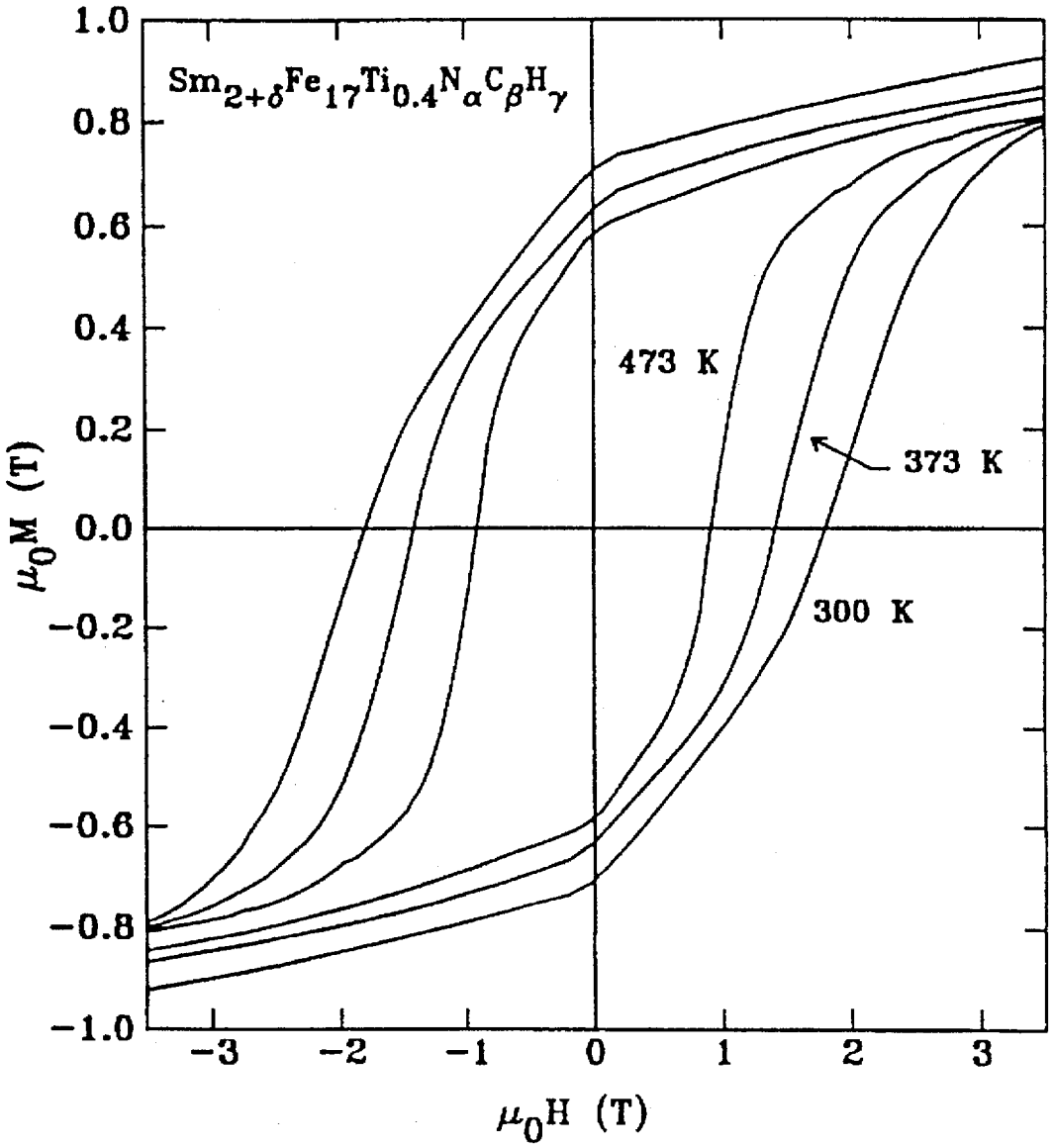
FIG. 9 shows hysteresis loops of $Sm_{2+\delta}Fe_{17}M_{0.4}N_\alpha C_\beta H_\gamma$ ($\delta \leqq 0.6$) at 300 K, 373 K and 473 K.

Typical hysteresis loops are shown in FIG. 9 for the specimen, $Sm_{2+\delta}Fe_{17}Ti_{0.4}N_\alpha C_\beta H_\gamma$ ($\delta \leqq 0.6$), prepared by the Hydrogenation Decomposition Desorption Recombination (HDDR) process. This isotropic magnet bas an intrinsic coercivity and an energy product of 1.8 T, 78.4 kJ/m$^3$ at 300 K; 1.4 T, 62.4 kJ/m$^3$ at 373 K and 0.9 T, 52 kJ/m$^3$ at 473 K. These properties are better than those of Nd-Fe-B based magnet made by the HDDR process.

Figure 10:
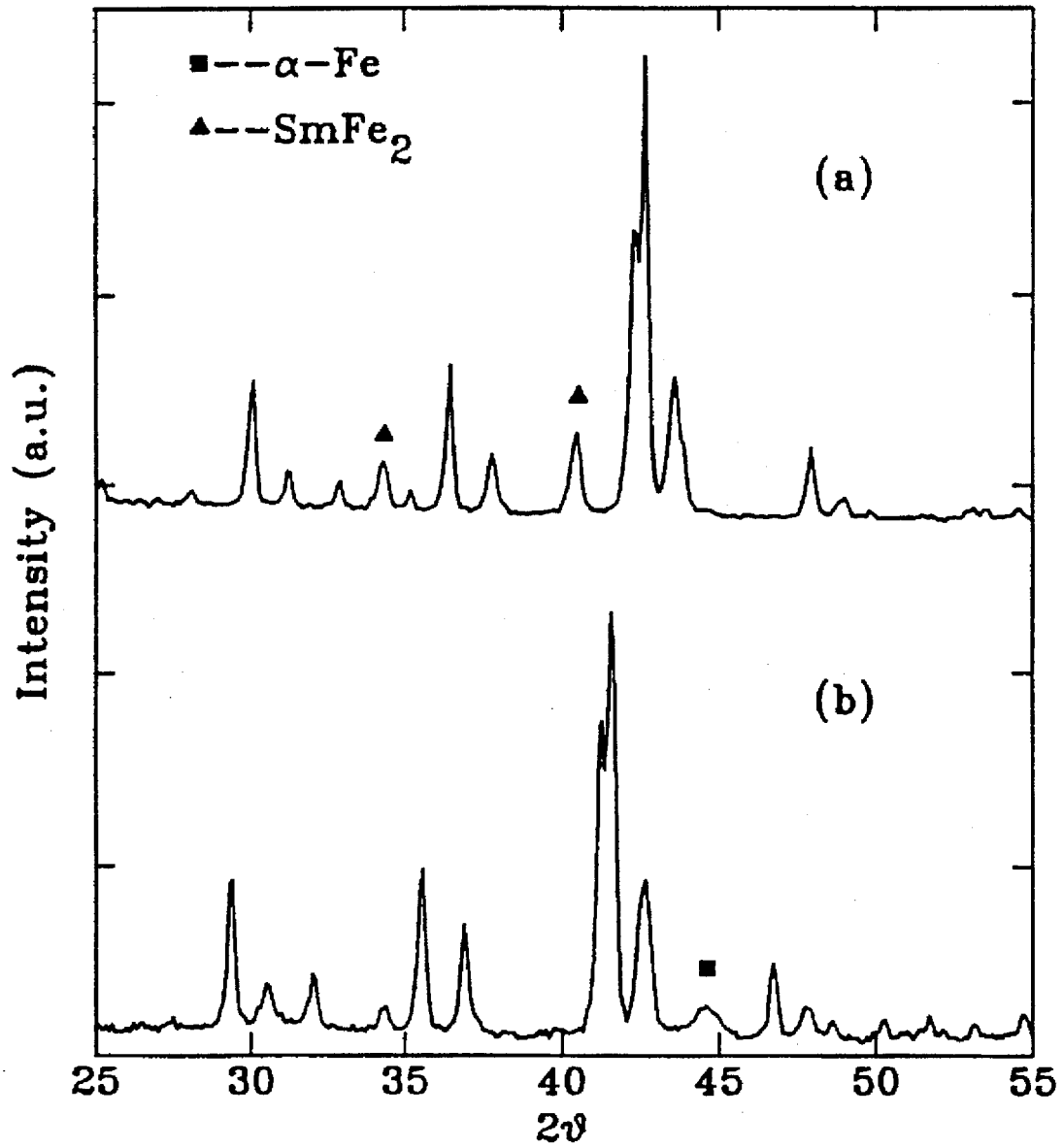
FIG. 10 shows X-ray (CuKα) powder diffraction pattern of specimens of $Sm_{2.08}Fe_{17}Ti_{0.4}$ after annealing in a mixture of nitrogen and hydrogen.

FIG. 10 plot a) is the X-ray diffraction pattern of $Sm_{2.08}Fe_{17}Ti_{0.4}$, and b) is a plot of a specimen (1.5×1.5×2.4 mm$^3$) of $Sm_{2.08}Fe_{17}Ti_{0.4}$ after annealing in a gas of $N_2$ mixed with $H_2$($N_2$:$H_2$=1:1) at 450° C. for 9 hours.

Figure 11:
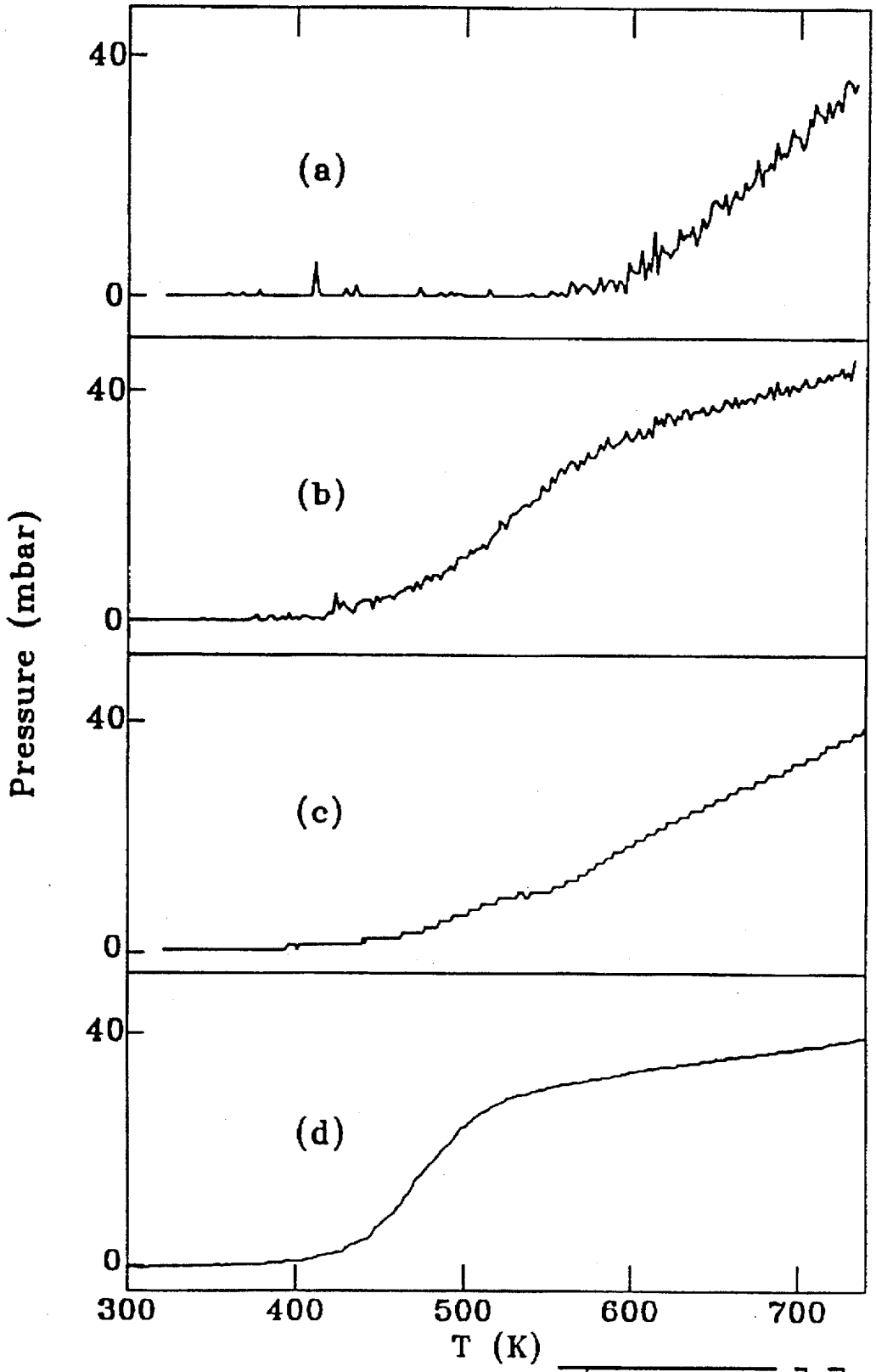
FIG. 11 demonstrates that the greatest thermal stability is achieved by nitriding followed by carbiding, in accordance with the invention.

In FIG. 11 TPA scans, under vacuum, show the onset temperatures of nitrogen outgassing for $Sm_2Fe_{17}$ annealed in (a) $N_2$ (470° C., 100 min.), followed by annealing in $C_2H_2$ (470° C., 20 min.); (b) $N_2$ (470° C., 100 min.); (c) $N_2$ mixed with $CH_4$ (1:1, 470° C., 110 min.); (d) $CH_4$ (470° C., 30 min.), followed by annealing in $N_2$ (470° C., 120 min.). The specimen prepared by nitriding, followed by carbiding (a) shows the best thermal stability, the onset temperature being at least 100 K higher than for the other specimens.

Figure 12:
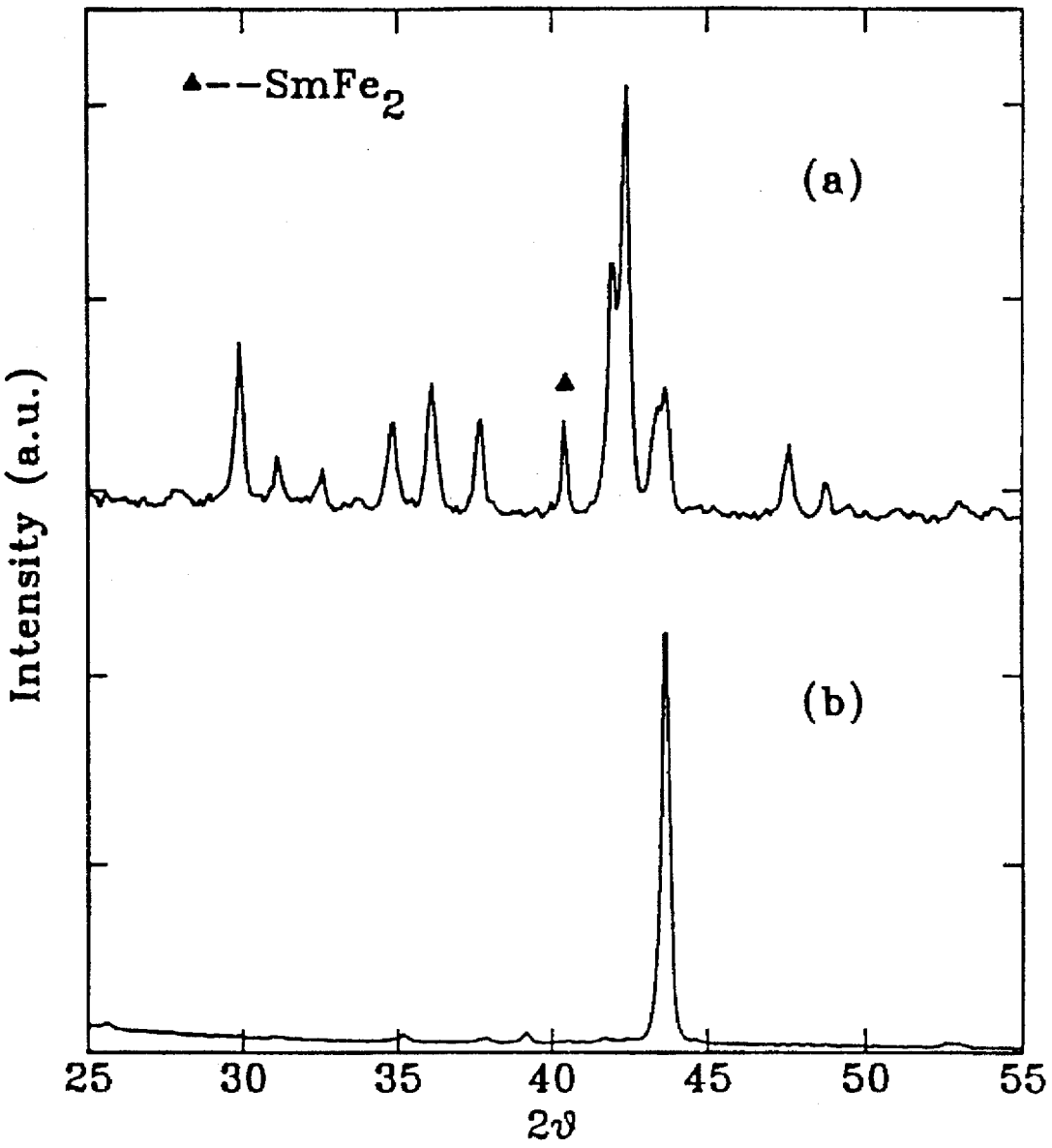
FIG. 12 is an X-ray (CuKα) powder diffraction demonstrating alignment of $Sm_2Fe_{17}Nb_{0.4}C$ in a magnetic field, prior to the nitriding of the invention.

In FIG. 12 plot a) is shown the X-ray diffraction pattern of $Sm_{2.1}Fe_{17}Nb_{0.4}C$ prepared by arc melting and induction melting, followed by thermal annealing in vacuum at 1150° C. for 14 hours; plot b) shows the specimen of plot a) but aligned in a magnetic field of 1.2 T, showing uniaxial anisotropy.

Figure 13:
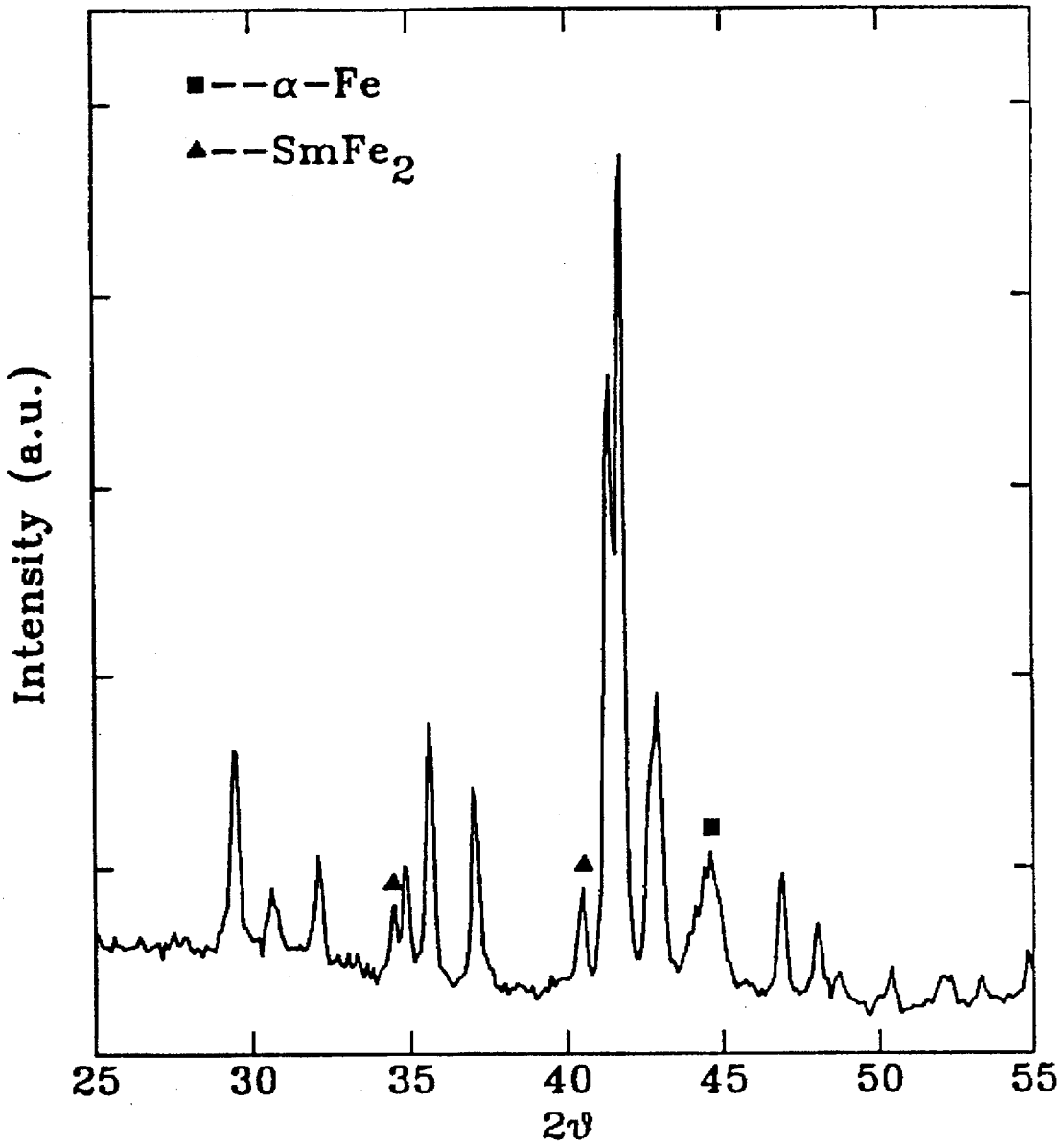
FIG. 13 demonstrates the full nitridation of $Sm_2Fe_{17}Nb_{0.4}C$.

FIG. 13 shows the X-ray diffraction pattern of the specimen of plot a) in FIG. 12 after annealing in $N_2$ at 450° C. for 4 hours, showing full lattice expansion.

TABLE 1

Crystal structures and magnetic properties of $R_xFe_yN_\alpha C_\beta H_\gamma$ ($\alpha + \beta \approx 3$).

| Compound | Structure | a(nm) | c(nm) | V(nm$^3$) | ΔV/V (%) | $\mu_0 M_s$(T) | $T_c$(K) | Anisotropy |
|---|---|---|---|---|---|---|---|---|
| $Ce_2Fe_{17}$ | $Th_2Zn_{17}$ | 0.849 | 1.240 | 0.774 | | — | 238[a] | plane |
| $Ce_2Fe_{17}N_\alpha C_\beta H_\gamma$ | $Th_2Zn_{17}$ | 0.873 | 1.268 | 0.837 | 8.1 | — | 721 | plane |
| $Pr_2Fe_{17}$ | $Th_2Zn_{17}$ | 0.857 | 1.244 | 0.791 | | — | 283[a] | plane |
| $Pr_2Fe_{17}N_\alpha C_\beta H_\gamma$ | $Th_2Zn_{17}$ | 0.879 | 1.266 | 0.847 | 7.1 | — | 737 | plane |
| $Nd_2Fe_{17}$ | $Th_2Zn_{17}$ | 0.857 | 1.245 | 0.792 | | — | 325 | plane |
| $Nd_2Fe_{17}N_\alpha C_\beta H_\gamma$ | $Th_2Zn_{17}$ | 0.876 | 1.265 | 0.841 | 6.1 | — | 740 | plane |
| $Sm_2Fe_{17}$ | $Th_2Zn_{17}$ | 0.854 | 1.243 | 0.785 | | — | 390 | plane |
| $Sm_2Fe_{17}N_\alpha C_\beta H_\gamma$ | $Th_2Zn_{17}$ | 0.875 | 1.265 | 0.839 | 6.8 | 1.3 | 758 | c-axis |
| $Gd_2Fe_{17}$ | $Th_2Zn_{17}$ | 0.850 | 1.243 | 0.782 | | — | 475 | plane |
| $Gd_2Fe_{17}N_\alpha C_\beta H_\gamma$ | $Th_2Zn_{17}$ | 0.870 | 1.267 | 0.831 | 6.2 | — | 764 | plane |
| $Tb_2Fe_{17}$ | $Th_2Zn_{17}$ | 0.847 | 1.244 | 0.773 | | — | 408[a] | plane |
| $Tb_2Fe_{17}N_\alpha C_\beta H_\gamma$ | $Th_2Zn_{17}$ | 0.865 | 1.271 | 0.824 | 6.5 | — | 748 | plane |
| $Dy_2Fe_{17}$ | $Th_2Ni_{17}$ | 0.845 | 0.829 | 0.512 | | — | 377 | plane |
| $Dy_2Fe_{17}N_\alpha C_\beta H_\gamma$ | $Th_2Ni_{17}$ | 0.866 | 0.848 | 0.551 | 7.6 | — | 724 | plane |
| $Er_2Fe_{17}$ | $Th_2Ni_{17}$ | 0.842 | 0.828 | 0.508 | | — | 305[a] | plane |
| $Er_2Fe_{17}N_\alpha C_\beta H_\gamma$ | $Th_2Ni_{17}$ | 0.863 | 0.849 | 0.548 | 7.8 | — | 700 | plane |
| $Tm_2Fe_{17}$ | $Th_2Ni_{17}$ | 0.840 | 0.828 | 0.506 | | — | 275[a] | plane |
| $Tm_2Fe_{17}N_\alpha C_\beta H_\gamma$ | $Th_2Ni_{17}$ | 0.859 | 0.849 | 0.543 | 7.2 | — | 694 | plane |
| $Y_2Fe_{17}$ | $Th_2Ni_{17}$ | 0.846 | 0.828 | 0.513 | | — | 322 | plane |
| $Y_2Fe_{17}N_\alpha C_\beta H_\gamma$ | $Th_2Ni_{17}$ | 0.866 | 0.848 | 0.551 | 7.4 | — | 717 | plane |

[a]K. H. J. Buschow, Rep. Prog. Phys. 40, 1179 (1977).

TABLE 2

Magnetic properties and lattice constants of $Sm_{2+\delta}Fe_{17}M_{0.4}N_\alpha C_\beta H_\gamma$ ($\delta \leqq 0.6$)

| Temperature (K.) | $\mu_0 H_A$(T) 480 | 500 | 520 | 550 | 590 | $T_c$(K) | a (nm) | c (nm) | V (nm$^3$) |
|---|---|---|---|---|---|---|---|---|---|
| $Sm_{2+\delta}Fe_{17}N_\alpha C_\beta H_\gamma$ | 8.7 | 7.8 | 7.0 | 5.9 | 5.0 | 758 | 0.875 | 1.265 | 0.839 |
| $Sm_{2+\delta}Fe_{17}Ti_{0.4}N_\alpha C_\beta H_\gamma$ | 9.1 | 8.3 | 7.4 | 6.4 | 4.7 | 739 | 0.873 | 1.266 | 0.836 |
| $Sm_{2+\delta}Fe_{17}V_{0.4}N_\alpha C_\beta H_\gamma$ | 8.8 | 7.8 | 7.0 | 6.2 | 4.7 | 741 | 0.873 | 1.267 | 0.836 |
| $Sm_{2+\delta}Fe_{17}Cr_{0.4}N_\alpha C_\beta H_\gamma$ | 8.1 | 7.4 | 6.7 | 5.6 | 4.6 | 746 | 0.872 | 1.268 | 0.835 |
| $Sm_{2+\delta}Fe_{17}Zr_{0.4}N_\alpha C_\beta H_\gamma$ | 7.5 | 6.9 | 6.3 | 5.1 | 4.2 | 750 | 0.871 | 1.270 | 0.834 |
| $Sm_{2+\delta}Fe_{17}Nb_{0.4}N_\alpha C_\beta H_\gamma$ | 8.5 | 7.5 | 6.7 | 5.7 | 4.4 | 741 | 0.873 | 1.267 | 0.836 |
| $Sm_{2+\delta}Fe_{17}Mo_{0.4}N_\alpha C_\beta H_\gamma$ | 8.0 | 7.2 | 6.5 | 5.5 | 4.1 | 730 | 0.873 | 1.268 | 0.837 |
| $Sm_{2+\delta}Fe_{17}Hf_{0.4}N_\alpha C_\beta H_\gamma$ | 7.7 | 7.1 | 6.4 | 5.2 | 4.3 | 757 | 0.872 | 1.267 | 0.834 |
| $Sm_{2+\delta}Fe_{17}Ta_{0.4}N_\alpha C_\beta H_\gamma$ | 8.6 | 7.6 | 6.9 | 5.9 | 4.7 | 751 | 0.873 | 1.267 | 0.836 |
| $Sm_{2+\delta}Fe_{17}W_{0.4}N_\alpha C_\beta H_\gamma$ | 8.0 | 7.2 | 6.4 | 5.3 | 4.3 | 731 | 0.872 | 1.269 | 0.836 |

EXAMPLE

Iron and titanium were arc melted together and cooled, four times to form $Fe_{17}Ti_{0.4}$; and the Sm and $Fe_{17}Ti_{0.4}$ were arc melted, followed by cooling, six times to form $Sm_{2+\delta}Fe_{17}Ti_{0.4}$ ($\delta \approx 0.6$). The latter intermetallic compound was induction melted twice to obtain a more uniform specimen which was subject to a Hydrogenation Decomposition Desorption Recombination (HDDR) process.

The resulting intermetallic compound was annealed in hydrogen at 750° C. for 20 minutes, at a hydrogen pressure of 1.5 bar, which was kept constant during the annealing.

Thereafter the specimen was annealed in a vacuum (<0.1 Torr), at 750° C. for 10 minutes.

The specimen was ground to a powder having a particle size of ≦40 μm and nitrided in an atmosphere of nitrogen at a pressure of 1.6 bar and a temperature of 450° C. for 9 hours. At the completion of the nitriding, residual nitrogen was removed.

The nitrided specimen was carbided in acetylene, at a pressure of 1.5 bar and a temperature of 450° C. for 10 minutes; at completion of the carbiding the specimen was cold pressed.

The materials (I), (II), (III) and (IV) in this specification have the main phase crystalline structure of $Th_2Zn_{17}$ or $Th_2Ni_{17}$.

We claim:

1. A process for producing a magnetically anisotropic magnetic material having an oriented c-axis comprising:

sintering compacted powder or hot shaping a material having a main phase of formula (IV):

$$R_\chi(Fe_{1-\eta}M_\eta)_\gamma C_\delta \quad \text{(IV)}$$

wherein

R is at least one element selected from Nd, Pr, La, Ce, Tb, Dy, Ho, Er, Eu, Sm, Gd, Pm, Tm, Yb, Lu and Y;

M is at least one element selected from Ti, V, Cr, Mn, Fe, Co, Ni, Zr, Nb, Mo, Hf, Ta, W, B, Al, Si, P, Ga, Ge and As;

$\chi$ is 0.1–8.5;

y is 15–19;

$\eta$ is 0–0.95; and $\delta$ is 0.05–2, and thereafter gas absorbing at least one of N and C in the resulting material.

2. A process according to claim 1, wherein $\delta$ is 0.1–1.

3. A process for producing a magnetically anisotropic magnetic material having an oriented c-axis comprising sintering compacted powder or hot shaping an intermetallic material containing at least one rare-earth metal, iron and carbon, optionally containing at least one element M selected from Ti, V, Cr, Mn, Fe, Co, Ni, Zr, Nb, Mo, Hf, Ta, W, B, Al, Si, P, Ga, Ge and As, and having a main phase of $Th_2Zn_{17}$ or $Th_2Ni_{17}$ structure and a Curie temperature, enhanced by interstitial carbon, of 400–600 K, and/or have a uniaxial anisotropic field, induced by interstitial carbon, of 0.1–7 T at 300° K., and thereafter gas absorbing at least one of N and C in the resulting material.

4. A process according to claim 1, wherein said material having the main phase of formula (IV) is sintered and the sintered material is sequentially nitrided and carbided, or is sequentially carbided and nitrided, or is nitrided only, or is carbided only, by gas absorption, or is carbonitrided in a mixture of N-containing gas and C-containing gas.

5. A process according to claim 1, wherein said material having the main phase of formula (IV) is subjected to hot shaping, and the hot shaped material is sequentially nitrided and carbided, or is sequentially carbided and nitrided, or is nitrided only, or is carbided only, by gas absorption, or is carbonitrided in a mixture of N-containing gas and C-containing gas.

6. A process according to claim 1 wherein N is gas absorbed in said resulting material.

7. A process according to claim 1 wherein C is gas absorbed in said resulting material.

8. A process according to claim 1 wherein N and C are gas absorbed in said resulting material.

9. A process according to claim 1 wherein said material having the main phase of formula (IV) is sintered and the sintered material is sequentially nitrided and carbided by gas absorption.

10. A process according to claim 1 wherein said material having the main phase of formula (IV) is sintered and the sintered material is sequentially carbided and nitrided by gas absorption.

11. A process according to claim 1 wherein said material having the main phase of formula (IV) is sintered and the sintered material is sequentially nitrided by gas absorption.

12. A process according to claim 1 wherein said material having the main phase of formula (IV) is sintered and the sintered material is sequentially carbided by gas absorption.

13. A process according to claim 1 wherein said material having the main phase of formula (IV) is sintered and the sintered material is sequentially carbonitrided in a mixture of N-containing gas and C-containing gas.

14. A process according to claim 1 wherein said material having the main phase of formula (IV) is subjected to hot shaping and the hot shaped material is sequentially nitrided and carbided by gas absorption.

15. A process according to claim 1 wherein said material having the main phase of formula (IV) is subjected to hot shaping and the hot shaped material is sequentially carbided and nitrided by gas absorption.

16. A process according to claim 1 wherein said material having the main phase of formula (IV) is subjected to hot shaping and the hot shaped material is nitrided by gas absorption.

17. A process according to claim 1 wherein said material having the main phase of formula (IV) is subjected to hot shaping and the hot shaped material is carbided by gas absorption.

18. A process according to claim 1 wherein said material having the main phase of formula (IV) is subjected to hot shaping and the hot shaped material is carbonitrided in a mixture of N-containing gas and C-containing gas.

* * * * *